US005884510A

United States Patent [19]

Crocco et al.

[11] Patent Number: 5,884,510

[45] Date of Patent: Mar. 23, 1999

[54] BOLT LOCK

[75] Inventors: John J. Crocco, Gurnee; Anthony R. Martinez, Richmond, both of Ill.

[73] Assignee: The Eastern Company, Wheeling, Ill.

[21] Appl. No.: 857,028

[22] Filed: May 15, 1997

[51] Int. Cl.[6] ..... E05B 67/36

[52] U.S. Cl. ..... 70/34; 70/38 A; 70/169; 70/371

[58] Field of Search ..... 70/34, 38 A, 371, 70/158, 163, 165–173, 32, 33, 120

[56] References Cited

U.S. PATENT DOCUMENTS

| | | | |
|---|---|---|---|
| 685,289 | 10/1901 | Mix | 70/38 A |
| 1,655,750 | 1/1928 | Campo | 70/371 |
| 1,660,903 | 2/1928 | Adamson | 70/38 A |
| 1,670,960 | 5/1928 | Gonyk | 70/34 |
| 1,779,716 | 10/1930 | Shaw | 70/38 A |
| 2,073,109 | 3/1937 | Kirkwood | 70/371 |
| 2,094,604 | 10/1937 | Keil | 70/38 A |
| 3,117,437 | 1/1964 | Russell et al. | 70/38 A |
| 3,254,516 | 6/1966 | Tornoe et al. | 70/38 A |
| 3,386,272 | 6/1968 | Schwartz | 70/371 |
| 3,505,837 | 4/1970 | Armstrong | 70/38 A |
| 3,915,335 | 10/1975 | Shanklin et al. | 70/169 X |
| 3,978,698 | 9/1976 | Ono | 70/165 |
| 3,979,931 | 9/1976 | Man | 70/38 A |
| 4,098,100 | 7/1978 | Wah | 70/38 A |
| 4,107,961 | 8/1978 | Evans | 70/165 |
| 4,160,511 | 7/1979 | Hukuta et al. | 70/167 X |
| 4,290,280 | 9/1981 | Yun | 70/38 A |

FOREIGN PATENT DOCUMENTS

| | | | |
|---|---|---|---|
| 877026 | 8/1971 | Canada | 70/38 A |
| 953722 | 12/1949 | France | 70/38 A |
| 1430488 | 10/1988 | U.S.S.R. | 70/34 |

*Primary Examiner*—Lloyd A. Gall
*Attorney, Agent, or Firm*—Wood, Phillips, VanSanten, Clark & Mortimer

[57] ABSTRACT

A bolt lock including a lock barrel having a central opening cylindrical about a central axis and extending between an open front end and a closed rear end. The lock barrel has bolt openings extending outwardly from opposite sides of the central opening adjacent the lock barrel rear end, with a pair of bolts received in opposite bolt openings. Each bolt has a head on one end, a leg on the other end with a rear side having a spring groove, and a front side with an axially extending shoulder. The bolt shoulders are planar and parallel to one another. The spring grooves are open at the end of the leg and parallel to and equidistant from a radius of the central axis. The bolts have their other ends in the central opening adjacent one another with the bolt legs substantially side by side when in a retracted position. A compression spring has one end disposed in one bolt spring groove and a second compression spring has one end disposed in the other bolt spring groove, where each spring extends from the open end of the groove and bears against the other bolt to bias the bolts apart. A lock plug in the barrel central opening has a pair of control lugs extending toward the barrel rear end. The lugs axially overlap with the bolt shoulders and the springs bias the bolts apart so that one shoulder engages one lug and the other shoulder engages the other lug.

15 Claims, 2 Drawing Sheets

BOLT LOCK

BACKGROUND OF THE INVENTION

1. Technical Field

The present invention is directed toward locks, and more particularly toward bolt locks for controlling access through an opening.

2. Background Art

Key locks are, of course, well known for use in many different applications.

In one application, such as commonly used with vending machines, the key locks are provided essentially to restrict access by blocking an opening. An authorized person with a key may remove the key lock from the opening, thereby unblocking the opening, allowing the authorized person access through the opening. Access may then be had, for example, to an internal switch, or to a screw which may be turned to permit opening of the unit (such as a vending machine).

Heretofore, key locks used for such applications have included a lock barrel received in the opening to be blocked, with a front bezel adapted to engage the surface around the opening and a retractable bolt spring biased from the other end of the barrel so as to secure the barrel in the opening by trapping the material around the barrel between the front bezel (or another shoulder defined about the barrel) and the rear bolt. While such bolt locks are adequate in many installations, they provide a somewhat skewed force holding them in, such that they might tend to twist due to the retaining force essentially coming at only one point around the annular surface. Such twisting could cause the front bezel to be skewed relative to the front surface around the blocked opening, thereby not only detracting from the appearance but also potentially creating a gap through which an intruder might attempt to manipulate the lock. If the installation has any imprecision or looseness allowing access between the lock barrel and the wall in which the opening is being covered, it can be relatively easy for a potential intruder to extend a tool though such a gap and manipulate the bolt into the barrel against the bias of the spring and then remove the lock to thereby gain access through the opening.

The present invention is directed toward overcoming one or more of the problems set forth above.

SUMMARY OF THE INVENTION

In one aspect of the present invention, a bolt lock is provided including a lock barrel having a central opening substantially cylindrical about a central axis and extending between an open front end and a closed rear end. The lock barrel has bolt openings extending outwardly from opposite sides of the central opening adjacent the rear end of the lock barrel. A pair of bolts are received in opposite of the lock barrel bolt openings. Each of the bolts have a bolt head on one end and a leg on the other end, a front side with an axially extending control shoulder, and a rear side facing the lock barrel rear end. A laterally extending groove is defined between the bolt rear side and the lock barrel rear end, and has facing ends defined by a pair of axially extending groove shoulders, with one of said groove shoulders on one bolt and the other of said groove shoulders on the other bolt. The bolts have their other ends disposed in the central opening adjacent one another with the bolt legs substantially side by side when in a retracted position. Biasing means are received in the defined laterally extending groove and engage both of the groove shoulders for biasing the bolts apart. A selectively rotatable lock plug is provided in the lock barrel central opening, with a pair of control lugs extending from the lock plug toward the barrel rear end. The lugs axially overlap with the bolt control shoulders and the springs bias the bolts apart to a balanced position with one control shoulder engaging one lug and the other control shoulder engaging the other lug.

In a preferred form of this aspect of the present invention, selective rotation of the lock plug is controlled by key operated plug tumblers cooperating with tumbler grooves with the barrel.

In another preferred form of this aspect of the present invention, two grooves are defined substantially parallel to and equidistant from a radius of the central axis, wherein the two grooves are in the rear side of the bolts with one of the grooves being in one of the bolt legs and the other of the grooves being in the other of the bolt legs, and the biasing means is two compression springs, one spring being disposed in each of the grooves.

In still another preferred form of this aspect of the present invention, the bolt control shoulders are substantially planar and parallel to one another, and the lugs where engaging the control shoulders are generally cylindrical about axes substantially parallel to the central axis and spaced substantially equidistantly on opposite sides of the barrel central opening axis.

In still another preferred form of this aspect of the present invention, means on the barrel and the plug limit rotation of the barrel in the plug between a first position in which the control lugs permit both of the bolt heads to project radially out of the lock barrel bolt openings and a second position in which the control lugs engage the bolt control shoulders to retain both of the bolt heads in the retracted position within the lock barrel bolt openings.

In another aspect of the present invention, a bolt lock is provided including a lock barrel having a central opening substantially cylindrical about a central axis and extending between an open front end and a closed rear end. The lock barrel has bolt openings extending outwardly from opposite sides of the central opening adjacent the rear end of the lock barrel. A pair of bolts are received in opposite of the lock barrel bolt openings. Each of the bolts have a bolt head on one end and a leg on the other end, a front side with an axially extending shoulder, and a rear side with a spring groove in the leg, the spring groove being open at the end of the leg. The bolts have their other ends disposed in the central opening adjacent one another with the bolt legs substantially side by side when in a retracted position. A compression spring has one end disposed in the spring groove of one bolt and a second compression spring has one end disposed in the spring groove of the other bolt, where each spring extends from the open end of the groove and bears against the other bolt to bias the bolts apart. A selectively rotatable lock plug is provided in the lock barrel central opening, with a pair of control lugs extending from the lock plug toward the barrel rear end. The lugs axially overlap with the bolt shoulders and the springs bias the bolts apart to a balanced position with one shoulder engaging one lug and the other shoulder engaging the other lug.

In a preferred form of this aspect of the present invention, selective rotation of the lock plug is controlled by key operated plug tumblers with the plug cooperating with tumbler grooves with the barrel.

In another preferred form of this aspect of the present invention, the spring grooves are substantially parallel to and equidistant from a radius of the central axis.

In still another preferred form of this aspect of the present invention, the bolt shoulders are substantially planar and parallel to one another, and the lugs where engaging the shoulders are generally cylindrical about axes substantially parallel to the central axis and spaced substantially equidistantly on opposite sides of the barrel central opening axis.

In yet another preferred form of this aspect of the present invention, each of the bolts has a second spring groove receiving the extending end of the compression spring in the first spring groove of the other bolt.

In still another preferred form of this aspect of the present invention, means on the barrel and the plug limit rotation of the barrel in the plug between a first position in which the control lugs permit both of the bolt heads to project radially out of the lock barrel bolt openings and a second position in which the control lugs engage the bolt shoulders to retain both of the bolt heads in the retracted position within the lock barrel bolt openings.

In still another aspect of the present invention, a bolt lock is provided including a lock barrel having a front face, a rear end, a central opening substantially cylindrical about a central axis, and a pair of axially extending tumbler slots in opposite sides of the opening. The lock barrel also has bolt openings extending outwardly from opposite sides of the central opening adjacent the rear end of the lock barrel in a direction substantially radial to the central axis. A pair of bolts are received in the lock barrel bolt openings, and each have a radially outward bolt head and a radially inwardly extending leg, where the legs of the bolts are disposed substantially side by side at the rear end of the lock barrel when in a retracted position. Each of the bolts has a front side with an axially extending shoulder and a rear side with a first spring groove along the leg. The first spring groove is open at the end of the leg. Compression springs are disposed in the first spring groove of each leg, with each spring having an end extending from the open end of the groove and bearing against the other bolt to bias the bolts radially apart toward projecting the bolt heads radially out of the lock barrel bolt openings. A lock plug in the lock barrel central opening has key operated tumblers cooperating with the tumbler slots to prevent rotation of the plug in the lock barrel without a key. A pair of control lugs extend from the lock plug rear end and overlap with the bolt shoulders whereby the springs bias the bolts apart to a balanced position with one shoulder engaging one lug and the other shoulder engaging the other lug.

In a preferred form of this aspect of the present invention, the first spring grooves are substantially parallel to and equidistant from a radius of the central axis.

In another preferred form of this aspect of the present invention, the bolt shoulders are substantially planar and parallel to one another, and the lugs where engaging the shoulders are generally cylindrical about axes substantially parallel to the axis of the barrel central opening, and the lug axes and the central opening axis lie in the generally the same plane.

In still another preferred form of this aspect of the present invention, each of the bolts has a second spring groove receiving the extending end of the compression spring in the first spring groove of the other bolt.

In yet another preferred form of this aspect of the present invention, means on the barrel and the plug limit rotation of the barrel in the plug between a first position in which the control lugs permit both of the bolt heads to project radially out of the lock barrel bolt openings and a second position in which the control lugs engage the bolt shoulders to retain both of the bolt heads in the retracted position within the lock barrel bolt openings.

It is an object of the invention to provide a bolt lock which may be used to reliably block an opening.

It is another object of the present invention to provide a bolt lock which will provide a long useful life.

It is yet another object of the present invention to provide a bolt lock which may be easily and inexpensively manufactured, installed and maintained.

It is still another object of the present invention to provide a bolt lock which may be reliably installed and maintained in the desired orientation covering an opening with a desired attractive appearance flush on a surface.

Another object of the present invention is to provide a bolt lock which cannot be manipulated and removed by unauthorized persons.

DESCRIPTION OF THE PREFERRED EMBODIMENT

Figure 1:
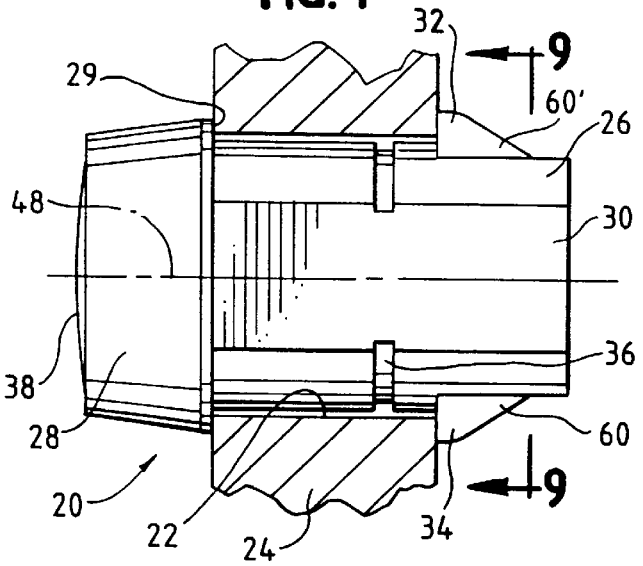
FIG. 1 is a side view of a bolt lock of the present invention as installed in an opening in a wall.

A bolt lock 20 according to the present invention is shown installed in an opening 22 in a wall 24 in FIG. 1. The lock 20 includes a barrel 26 having a front bezel 28 with a rearwardly facing shoulder 29 engageable with the front surface of the wall 24. In the preferred form, the barrel 26 may also include flat sides 30 cooperating with flat sides on the wall opening 22 both to assist in properly orienting the bolt lock 20 in the opening 22 and to secure the lock 20 against turning in the opening 22.

A pair of bolts 32, 34 are disposed at the rear end of the barrel 26. As described in greater detail hereafter, these bolts 32, 34 cooperate to selectively secure the bolt lock 20 in the opening 22, and may further be retracted to selectively release the bolt lock 20 from the opening 22.

In the form shown in FIG. 1, the bolt lock 20 is secured directly to a wall 24. However, in some installations, it may be desirable to secure the lock 20 to something behind a wall. For example, a cylindrical member adapted to receive the bolt lock 20 could be secured behind the wall, with side bolt openings provided in the cylindrical member spaced a selected distance from the front end of the member. In such case, the groove 36 (see FIG. 1) disposed the selected distance from the bolts 32, 34 on the barrel 26 could be used to secure a suitable C-clamp (not shown), with the bolts 32, 34 and C-clamp cooperating to secure the bolt lock 20 to the cylindrical member behind the wall.

Figure 2:
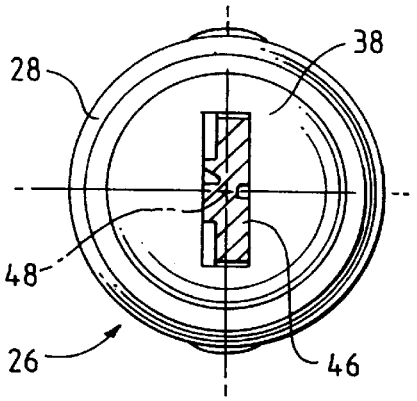
FIG. 2 is front view of the bolt lock of FIG. 1.
Figure 3:
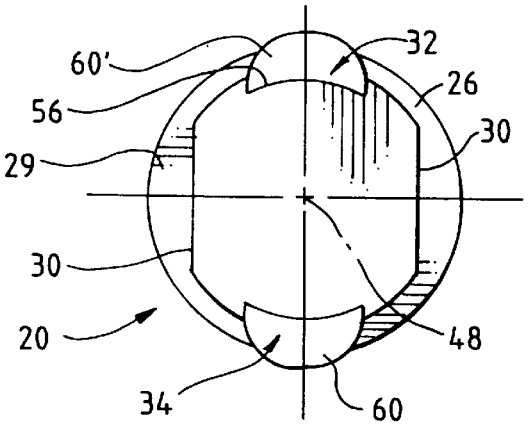
FIG. 3 is a rear view of the bolt lock of FIG. 1.
Figure 4:
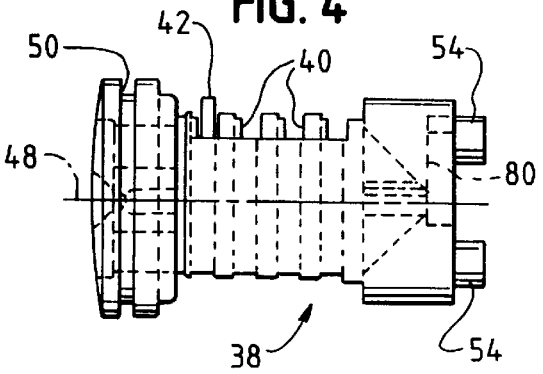
FIG. 4 is a side view of a lock plug as used with the bolt lock of the present invention.

A plug body 38 is received in a generally cylindrical opening in the barrel 26. As is generally known in the art, the plug body 38 can be provided with a plurality of radial slots 40 receiving tumblers 42 (one of which is shown in FIG. 4) which are biased outwardly from the slots 40 so that, when projecting outwardly, they are received in generally axially extending slots along the sides of the barrel cylindrical opening to prevent turning of the plug in the barrel 26. With such a generally well known plug/barrel construction, a key 46 (see FIG. 2) cut to cooperate with openings in the tumblers 42 may be inserted into the plug body 38, retracting the tumblers 42 into the plug body 38 to free the body 38 to turn in the lock barrel 26 about central axis 48.

The plug body 38 is suitably secured in the barrel 26. For example, with the plug body 38 shown in the FIG. 4, an annular groove 50 is provided in the front end of the plug 38 for a C-spring (not shown). When the plug 38 is inserted into the barrel 26, the C-spring will spring out into an annular groove inside the barrel bezel 28, so that the C-spring thereafter cooperates in the grooves in both the barrel 26 and the plug body 38 to retain them together. Of course, many other configurations for retaining the plug body 38 in the barrel 26 could be used within the scope of this invention, including using a special tumbler disposed behind a shoulder in the barrel where such tumbler is not retracted by a normal operating key.

While the above described plug/barrel construction is a preferred form used with the present invention, it should be understood that still other configurations may readily be used within the scope of the present invention described below.

At the rear end of the plug body 38, a pair of generally cylindrical lugs 54 are provided on opposite sides of, and equally spaced from, the central axis 48. When the plug body 38 is secured in the barrel 26, the lugs 54 are preferably partially overlapping with the radially extending bolt openings 56 (see FIG. 10) in the barrel 26 and, as described hereafter, cooperate with the bolts 32, 34 to both retain the bolts 32, 34 in the barrel 26 and also to retract the bolts 32, 34 into the barrel 26.

Figure 6:
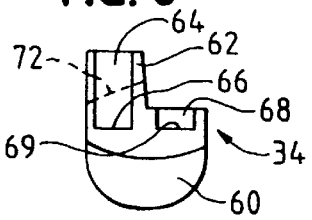
FIG. 6 is a rear view of one bolt as used with the bolt lock of the present invention.
Figure 7:
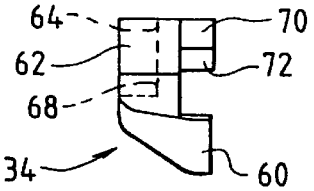
FIG. 7 is a side view of the bolt of FIG. 6.
Figure 8:
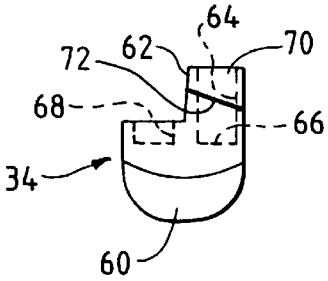
FIG. 8 is a front view of the bolt of FIG. 6.
Figure 9:
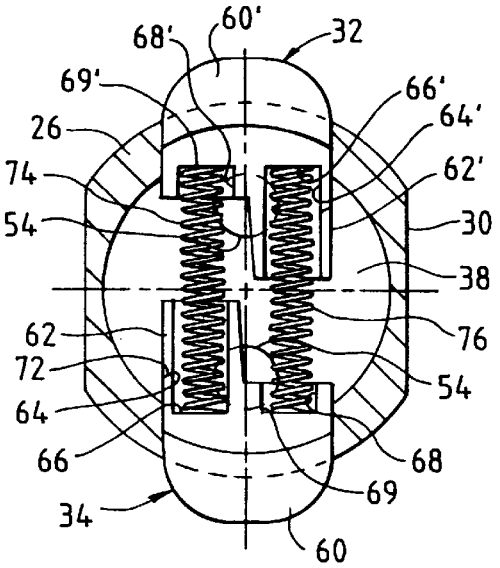
FIG. 9 is a cross-sectional view taken along line 9—9 of FIG. 1.
Figure 10:
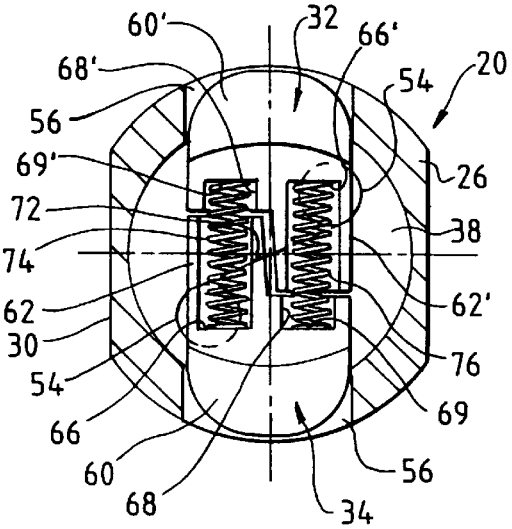
FIG. 10 is a cross-sectional view similar to FIG. 9 but showing the bolts in a retracted position.

One of the bolts 34 is shown in detail in FIGS. 6–8. The bolt 34 includes a bolt head 60 on its radially outer end and a leg 62 offset to one side on its radially inner end facing the other bolt 32 so that, when the bolts are retracted as shown in FIG. 10, the legs 62 of the bolts 32, 34 overlap one another in substantially side-by-side orientation on opposite sides of the central axis 48. (The bolts 32, 34 are mirror images of one another, and therefore mirror image elements of the other bolt 32 in FIGS. 9–10 are referred to with the same numbers plus prime (e.g., bolt head 60' of bolt 32)).

The rear face of the leg 62 includes a spring groove 64 which is open on the rear end of the leg 62 and has a shoulder 66 on the opposite end. A shorter spring groove 68 is provided on the opposite side of the bolt 34, so that the two grooves 64, 68 are substantially parallel to and equidistant from a radius of the central axis 48. The shorter spring groove 68 also has a shoulder 69 at its forward end.

When the two bolts 32, 34 are assembled in the bolt openings 56, the spring groove 64 of the one bolt 34 is aligned with the shorter spring groove 68' of the other bolt 32 with the shoulders 66, 69' facing to close opposite ends of the combined grooves 64, 68'. Similarly, the shorter spring groove 68 of the one bolt 34 is aligned with the spring groove 64' of the other bolt 32 with the shoulders 66', 69 facing to close opposite ends of the combined grooves 64', 68. The combined grooves 64, 68' and 64', 68 therefore are substantially parallel to and equidistant from a radius of the central axis 48.

The front side of the bolt leg 62 includes a flange portion 70 defining an axially extending control shoulder 72 which axially overlaps with and is engaged by one of the lugs 54 as described in detail below. In a preferred form, the control shoulders 72, 72' of the bolts 32, 34 are substantially planar and parallel to one another to assist in ensuring that both bolts 32, 34 operate together as described below.

Compression springs 74, 76 are disposed in the combined grooves 64, 68' and 64', 68 of the assembled bolt lock 20, biasing against the shoulders 66, 70' and 66', 70 at opposite ends of the grooves to bias the bolts 32, 34 apart, toward an extended position with the bolt heads 60, 60' extending from the sides of the barrel 26. Due to the substantially equal spacing of the springs 74, 76 on opposite sides of the central axis 48, a substantially balanced radially oriented biasing force is provided.

The compression springs 74, 76 essentially bias the bolts 32, 34 so that their control shoulders 72, 72' are held against the control lugs 54. The lugs 54 therefore not only operate to control the position of the bolts 32, 34 against the outward bias of the springs 74, 76, but also retain the bolts 32, 34 in the barrel 26 of the assembled bolt lock 20.

As shown in FIG. 9, in a normal locked position, the bolts 32, 34 are biased outwardly to a locked position, with the lugs 54 generally aligned with the radial direction of the bolt openings 56. The springs 74, 76 ensure that the bolts 32, 34 extend from the barrel 26, but the bolts may also be retracted into the barrel 26 if directly pushed in against the bias of the springs 74, 76.

By turning the plug body 38 a selected amount (such turning, of course, requiring an authorized key 46 as previously discussed), such as approximately a 45 degree turn as shown in FIG. 10, the lugs 54 of the plug body 38 bear against the control shoulders 72, 72' of the bolts 32, 34 to retract them into the lock barrel 26. In such a position, the bolt lock 20 may then easily be removed from the wall opening 22 by an authorized person having the requisite key 46. When the key 46 is released by the person operating the lock 20, the bias of the springs 74, 76 will push the bolts 32, 34 against the lugs 54 to return the bolts 32, 34 to their extended position and to also return the plug body 38 to its centered, initial position.

Figure 5:
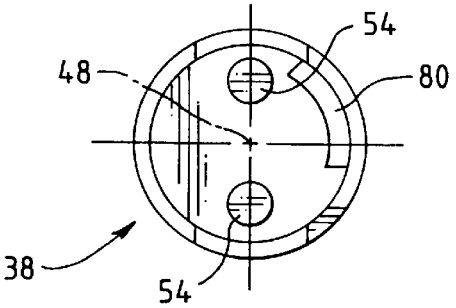
FIG. 5 is a rear view of the lock plug of FIG. 4.

A suitable stop structure may be used to limit the range of motion of the plug body 38 in the barrel 26 to the desired amount. For example, a groove 80 (see FIGS. 4–5) may be provided at the rear end of the plug body 38 having stop shoulders at opposite ends and cooperating with a lug (not shown) inside the barrel 26. Many other constructions suitably limiting pivoting of the plug body 38 to the necessary range of motion are, however, possible and within the scope of the present invention.

It should be understood that balanced operation of the bolts 32, 34 of the present invention could also be provided with different orientations of the control shoulders 72, 72' and lugs 54. For example, suitable balanced operation would be provided even though the lugs 54 may not be entirely cylindrical, where the portions of the lugs 54 which engage the control shoulders 72, 72' through the range of operational motion are cylindrical. Of course, still other cooperating shapes of the control shoulders 72, 72' and lugs 54 providing balanced operation could also be used.

Figure 11:
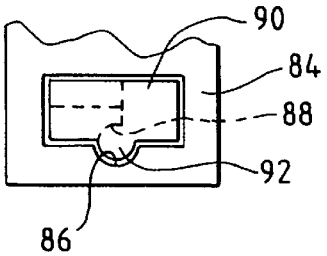
FIG. 11 is a side view of the rear end of an alternative embodiment of a bolt lock embodying the present invention.

FIG. 11 illustrates an alternative embodiment of the present invention, in which a single compression spring may be used. In such a configuration, the lock barrel 84 is preferably provided with a radial groove 86 in its rear end, where a suitable compression spring can be disposed in the radial groove 86 and a cooperating radial groove 88 in the bolt 90. The bolt 90 further preferably includes a rearwardly extending flange 92 received in the barrel groove 86, which flange 92 helps to guide the bolt 90 and also includes an inwardly facing shoulder against which the compression spring bears. As with the first described embodiment, the other bolt (not shown) is essentially a mirror image of the one shown in FIG. 11, with both provided with legs which overlap when the bolts are retracted.

The first described embodiment, however, has been found to be advantageous over the FIG. 11 embodiment in installations where space limitations require that the length of the overall bolt lock be minimized, since minimal space at the end of the barrel 26 is required beyond the bolts 32, 34 of the first embodiment. (Shortening the plug body 38 typically is not possible due to the standard plug sizes required for standard key sizes). Further, the use of two compression springs 74, 76 as with the first described embodiment allows for use of relatively inexpensive springs while still providing a strong and reliable biasing force for ideal operation. When installing the bolt lock, a strong biasing force assists in getting the bolts to snap out into a locking/extended position in tight fits where there may be some frictional sliding around the opening resisting extension of the bolts. Of course, a strong biasing force also provides good security against unauthorized manipulation of the bolts.

Locks 20 according to the present invention may be easily and inexpensively manufactured, installed and maintained, while also providing an attractive appearance over a long useful life. Further, such locks 20 will provide strong protection against unauthorized access through an opening 22. Even if an intruder were to gain access to attempt to manipulate one of the bolts 32, 34 through use of a tool worked between the opening 22 and the lock barrel 26, retracting one of the bolts 32, 34 would not be sufficient to remove the bolt lock 20. Moreover, it should be recognized that even if an unauthorized person were able to push one bolt 32, 34 into a retracted position, this would cause the springs 74, 76 to compress, effectively increasing the biasing force against the other of the bolts 34, 32 and thereby making it all the more difficult to retract the other bolt 34, 32 even in the unlikely event that the person was able to gain some access to attempt to manipulate the other bolt 34, 32.

Still other aspects, objects, and advantages of the present invention can be obtained from a study of the specification, the drawings, and the appended claims.

We claim:

1. A bolt lock, comprising:

a lock barrel having a central opening substantially cylindrical about a central axis and extending between an open front end and a closed rear end, said lock barrel being receivable in an opening of a barrier wall and further having bolt openings extending outwardly from opposite sides of the central opening adjacent the rear end of the lock barrel;

a head on said lock barrel larger than the opening in the barrier wall within which the lock barrel is receivable;

a pair of bolts each having a bolt head on one end and a leg on the other end, a front side with an axially extending control shoulder, and a rear side facing said lock barrel rear end;

wherein said bolts are received in opposite of said lock barrel bolt openings with said bolt other ends disposed in said central opening adjacent one another with the bolt legs disposed substantially side by side when in a retracted position;

means defining two laterally extending grooves substantially parallel to and equidistant from a radius of said central axis, each of said two grooves being in the rear side of the bolts between said bolt rear sides and said lock barrel rear end with one of the grooves being in one of the bolt legs and the other of the grooves being in the other of the bolt legs, said grooves each having facing ends defined by a pair of axially extending groove shoulders with one of said groove shoulders on one bolt and the other of said groove shoulders on the other bolt;

two compression springs, one spring disposed in each of said defined laterally extending grooves and engaging both of said groove shoulders for biasing said bolts apart to an extended position projecting outwardly from the lock barrel for preventing removal of the lock barrel from the opening in the barrier wall within which the lock barrel is receivable;

a lock plug in said lock barrel central opening having means for selectively controlling rotation of said plug in said lock barrel; and a pair of control lugs extending from the lock plug toward the barrel rear end and axially overlapping with said bolt control shoulders whereby said biasing means bias said bolts apart to a balanced position with one control shoulder engaging one lug and the other control shoulder engaging the other lug.

2. The bolt lock of claim 1, wherein said rotation controlling means comprise key operated tumblers with said plug cooperating with tumbler grooves with said barrel.

3. The bolt lock of claim 1, wherein said bolt control shoulders are substantially planar and parallel to one another, and said lugs where engaging said control shoulders are generally cylindrical about axes substantially parallel to the axis of the barrel central opening and spaced substantially equidistantly on opposite sides of said barrel central opening axis.

4. The bolt lock of claim 1, further comprising means on said barrel and said plug for limiting rotation of said plug in said barrel between the extended position in which said control lugs permit both of said bolt heads to project radially out of said lock barrel bolt openings and a second position in which said control lugs engage said bolt control shoulders to retain both of said bolt heads in said retracted position within said lock barrel bolt openings.

5. A bolt lock, comprising:

a lock barrel having a central opening substantially cylindrical about a central axis and extending between an open front end and a closed rear end, said lock barrel being receivable in an opening of a barrier wall and further having bolt openings extending outwardly from opposite sides of the central opening adjacent the rear end of the lock barrel;

a head on said lock barrel larger than the opening in the barrier wall within which the lock barrel is receivable;

a pair of bolts each having a bolt head on one end and a leg on the other end, a front side with an axially extending shoulder, a rear side with a spring groove in the leg, said spring groove being open at the end of the leg;

wherein said bolts are received in opposite of said lock barrel bolt openings with said bolt other ends disposed in said central opening adjacent one another with the bolt legs disposed substantially side by side when in a retracted position;

a pair of compression springs, one spring having one end disposed in the spring groove of one bolt and the other spring having one end disposed in the spring groove of the other bolt, each spring extending from the open end of the groove and bearing against the other bolt to bias said bolts apart to an extended position projecting outwardly from the lock barrel for preventing removal of the lock barrel from the opening in the barrier wall within which the lock barrel is receivable;

a lock plug in said lock barrel central opening having means for selectively controlling rotation of said plug in said lock barrel; and a pair of control lugs extending from the lock plug toward the barrel rear end and axially overlapping with said bolt shoulders whereby said springs bias said bolts apart to a balanced position with one shoulder engaging one lug and the other shoulder engaging the other lug.

6. The bolt lock of claim 5, wherein said rotation controlling means comprise key operated tumblers with said plug cooperating with tumbler grooves with said barrel.

7. The bolt lock of claim 5, wherein the spring grooves are substantially parallel to and equidistant from a radius of said central axis.

8. The bolt lock of claim 5, wherein said bolt shoulders are substantially planar and parallel to one another, and said lugs where engaging said shoulders are generally cylindrical about axes substantially parallel to the axis of the barrel central opening and spaced substantially equidistantly on opposite sides of said barrel central opening axis.

9. The bolt lock of claim 5, wherein each of said bolts has a second spring groove receiving the extending end of the compression spring in the first spring groove of the other bolt.

10. The bolt lock of claim 5, further comprising means on said barrel and said plug for limiting rotation of said plug in said barrel between the extended position in which said control lugs permit both of said bolt heads to project radially out of said lock barrel bolt openings and a second position in which said control lugs engage said bolt shoulders to retain both of said bolt heads in said retracted position within said lock barrel bolt openings.

11. A bolt lock, comprising:

a lock barrel having a front face, a rear end, a central opening substantially cylindrical about a central axis, and a pair of axially extending tumbler slots in opposite sides of said opening, said lock barrel being receivable in an opening of a barrier wall and further having bolt openings extending outwardly from opposite sides of the central opening adjacent the rear end of the lock barrel in a direction substantially radial to the central axis;

a head on said lock barrel larger than the opening in the barrier wall within which the lock barrel is receivable:

a pair of bolts received in said lock barrel bolt openings, each of said bolts having a radially outward bolt head and a radially inwardly extending leg, wherein the legs of said bolts are disposed substantially side by side at the rear end of the lock barrel when in a retracted position;

wherein each of said bolts has a front side and a rear side with an axially extending shoulder on said front side and a first spring groove along the leg in the rear side, said first spring groove being open at the end of the leg;

compression springs in the first spring groove of each leg, each spring having an end extending from the open end of the groove and bearing against the other bolt to bias said bolts radially apart toward projecting the bolt heads radially out of said lock barrel bolt openings to an extended position projecting outwardly from the lock barrel for preventing removal of the lock barrel from the opening in the barrier wall within which the lock barrel is receivable;

a lock plug in said lock barrel central opening having key operated tumblers cooperating with said tumbler slots to prevent rotation of said plug in said lock barrel without a key, said lock plug having a front face adjacent said lock barrel front face and a rear end facing the rear end of the lock barrel; and a pair of control lugs extending from the lock plug rear end and overlapping with said bolt shoulders whereby said springs bias said bolts apart to a balanced position with one shoulder engaging one lug and the other shoulder engaging the other lug.

12. The bolt lock of claim 11, wherein the first spring grooves are substantially parallel to and equidistant from a radius of said central axis.

13. The bolt lock of claim 11, wherein said bolt shoulders are substantially planar and parallel to one another, and said lugs where engaging said shoulders are generally cylindrical about axes substantially parallel to the axis of the barrel central opening, and said lug axes and said central opening axis lie in generally the same plane.

14. The bolt lock of claim 11, wherein each of said bolts has a second spring groove receiving the extending end of the compression spring in the first spring groove of the other bolt.

15. The bolt lock of claim 11, further comprising means on said barrel and said plug for limiting rotation of said plug in said barrel between the extended position in which said control lugs permit both of said bolt heads to project radially out of said lock barrel bolt openings and a second position in which said control lugs engage said bolt shoulders to retain both of said bolt heads in said retracted position within said lock barrel bolt openings.

* * * * *